US005600342A

United States Patent [19]

Pikulski et al.

[11] Patent Number: 5,600,342

[45] Date of Patent: Feb. 4, 1997

[54] DIAMOND LATTICE VOID STRUCTURE FOR WIDEBAND ANTENNA SYSTEMS

[75] Inventors: Joseph L. Pikulski, Westlake; Juan F. Lam, Agoura Hills, both of Calif.

[73] Assignee: Hughes Aircraft Company, Los Angeles, Calif.

[21] Appl. No.: 416,626

[22] Filed: Apr. 4, 1995

[51] Int. Cl.[6] ..... H01A 15/00

[52] U.S. Cl. ..... 343/909; 343/795

[58] Field of Search ..... 343/846, 795, 343/909, 911 R, 834

[56] References Cited

U.S. PATENT DOCUMENTS

| | | | |
|---|---|---|---|
| 3,465,361 | 9/1969 | Lode | 343/911 R |
| 5,041,839 | 8/1991 | Rees | 343/700 MS |
| 5,385,114 | 1/1995 | Milstein et al. | 117/1 |
| 5,386,215 | 1/1995 | Brown | 343/795 |
| 5,389,943 | 2/1995 | Brommer et al. | 343/787 X |
| 5,971,180 | 11/1995 | Brommer et al. | 343/909 |

OTHER PUBLICATIONS

K. M. Ho, C. T. Chan and C. M. Soukoulis, "Existence of Photonic Band Gap in Periodic Dielectric Structures," Phys Rev. lett. vol. 65, No. 25, 17 Dec. 1990, pp. 3152–3155.

E. R. Brown, C. D. Parker and E. Yablonovitch, "Radiation Properties of a Planar Antenna on a Photonic–Crystal Substrate," J. Opt. Soc. Am. B, vol. 10, No. 2, Feb. 1993, pp. 404–407.

E. Yablonovitch, "Photonic Bandgap Structures," J. Opt. Soc. Am. B, vol. 10, No. 2, Feb. 1993, pp. 283–295.

*Primary Examiner*—Donald T. Hajec
*Assistant Examiner*—Tho Phan
*Attorney, Agent, or Firm*—V. D. Duraiswamy; W. K. Denson-Low

[57] ABSTRACT

A diamond lattice structure is employed as a ground plane in an array antenna system. The ground plane structure reflects incident energy radiated by the antenna radiating elements. The structure is fabricated from a layer of dielectric photonic band gap material in which a periodic void structure is defined. The void diameter is selected to maximize the void volume within the structure. Methods of constructing the ground plane are described.

17 Claims, 3 Drawing Sheets

DIAMOND LATTICE VOID STRUCTURE FOR WIDEBAND ANTENNA SYSTEMS

TECHNICAL FIELD OF THE INVENTION

This invention relates to the field of phased array radar systems, and more particularly to a diamond lattice structure useful as a ground plane in wideband phase array antenna systems.

BACKGROUND OF THE INVENTION

Phased array antennas typically include an array of radiating elements backed by a ground plane, with a high dielectric medium disposed between the ground plane and the radiating element array. The backward propagating wave from the radiating element array passes through the dielectric medium, and is reflected by the ground plane back through the dielectric. The function of the dielectric is to introduce a net phase shift such that the reflected wave is coherently added to the forward propagating wave travelling away from the array. Conventional phased array antennas employing such a configuration suffer from large radiation trapping and crosstalk due to the presence of radiation emitted by the antenna to be absorbed in the high dielectric medium.

Antennas are widely utilized in microwave and millimeter-wave integrated circuits for radiating signals from an integrated chip into free space. These antennas are typically fabricated monolithically on III-V semiconductor substrate materials such as GaAs or InP.

To understand the problems associated with antennas fabricated on semiconductor substrates, one needs to look at the fundamental electromagnetic properties of a conductor on a dielectric surface. Antennas, in general, emit radiation over a well defined three-dimensional angular pattern. For an antenna fabricated on a dielectric substrate with a dielectric constant $\epsilon_r$, the ratio of radiated power into the dielectric to radiated power into the free space is $\epsilon_r^{3/2}$. Thus, a planar antenna on a GaAs substrate ($\epsilon_r$=12.8) radiates 46 times more power into the substrate than into the air.

Another problem is that the power radiated into the substrate at angles greater than $$\Theta_c=\sin^{-1}\epsilon_r^{-1/2}$$

totally internally reflected at the top and bottom substrate-air interfaces. In GaAs, for instance, this occurs at an angle of 16 degrees. As a result, the vast majority of the radiated power is trapped in the substrate.

Some of this lost power can be recovered by placing a groundplane (a conducting plane beneath the dielectric) one-quarter wavelength behind the radiating surface of the antenna. This technique is acceptable provided the antenna emits monochromatic radiation. In the case of an antenna that emits a range of frequencies (a broadband antenna), the use of a groundplane will not be effective unless the dielectric constant ($\epsilon_r$) has a 1/(frequency)$^2$ functional dependence and low loss. No material has been found that exhibits both the low loss and the required $\epsilon_r$ dependence over the large bandwidth that is desired for some antenna systems.

One way to overcome these problems is to use a three-dimensional photonic bandgap crystal as the antenna substrate. A photonic bandgap crystal is a periodic dielectric structure that exhibits a forbidden band of frequencies, or bandgap, in its electromagnetic dispersion relation. These photonic bandgap materials are well known in the art. For example, see K. M. Ho, C. T. Chan and C. M. Soukoulis, "Existence of Photonic Band Gap in Periodic Dielectric Structures," Phys, Rev. Lett. 67, 3152 (1990) and E. Yablonovitch, "Photonic Bandgap Structures," J. Opt. Soc. Am. B 10, 283 (1993).

The effect of a properly designed photonic bandgap crystal substrate on a radiating antenna is to eject all of the radiation from the substrate into free space rather than absorbing the radiation, as is the case with a normal dielectric substrate. The radiation is ejected or expelled from the crystal through Bragg scattering. This concept has been described in E. R. Brown, C. D. Parker and E. Yablonovitch, "Radiation Properties of a Planar Antenna on a Photonic-Crystal Substrate," J. Opt. Soc. Am. B 10, 404 (1993). Manufacturing methods for photonic bandgap crystals of the simple face cubic center geometry type are well known in the art. For example, see E. Yablonovitch, "Photonic Bandgap Structures," J. Opt. Soc. Am. B 10, 183 (1993).

SUMMARY OF THE INVENTION

In a general sense, one aspect of this invention is a diamond lattice void structure which is shown, in theory, to have the largest stopband for omnidirectional antenna applications, and a fabrication methodology for producing the diamond lattice void structure. The omnidirectionality arises from the three-dimensional symmetry structure of the diamond lattice. Such properties, i.e., the large stopband and omnidirectionality, do not exist in conventional antenna systems.

An antenna array is described which includes an array of radiators, and a ground plane spaced below the array of radiators for reflecting incident energy radiated by the array. The ground plane comprises a layer of dielectric photonic band gap material. A periodic structure of voids is defined in the dielectric material to form an atomic diamond structure.

In accordance with another aspect of the invention, a method is described for producing a diamond lattice void structure useful as the ground plane for wideband antenna systems. The method comprises the following steps;

providing a plurality of slabs of a high dielectric, photonic band gap material, the slabs having a predetermined thickness, each slab having first and second surfaces;

forming a predetermined pattern of voids in each of said slabs;

assembling said slabs together to form a composite void structure, said predetermined slab thickness and said predetermined pattern of voids being selected such that said void structure emulates a diamond lattice.

In one embodiment, the step of forming a predetermined pattern of voids includes forming a pattern of hemispherical voids in the slabs, and wherein the slabs when assembled together match together corresponding hemispherical voids in adjacent slabs to define a pattern of spherical voids in the composite structure.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

In accordance with this invention, a phased array system employs a photonic band-gap material in a ground plane structure. In a preferred embodiment, the photonic band-gap material is fabricated in a diamond void structure. A diamond void structure as used herein is a diamond lattice structure which has voids, i.e., empty pockets or spheres that reside at all points of the lattice. A diamond lattice structure refers to a geometric structure that is made of lines or sticks that represent the bond lines that join together the atoms of a diamond lattice. A diamond lattice is defined as a geometric representation of the arrangement of carbon atoms that is formed by two interpenetrating face centered cubics. To form the diamond void structure according to one embodiment of the invention, spherical voids are formed in a high dielectric material at all of the points of these cubes at which the bond lines intersect. It is the periodicity of the diamond structure that introduces a bandgap in which the radiation field is forbidden to propagate. This effect is similar to that found in a regular solid where the bandgap exists because of the periodicity of the solid lattice.

Figure 1:
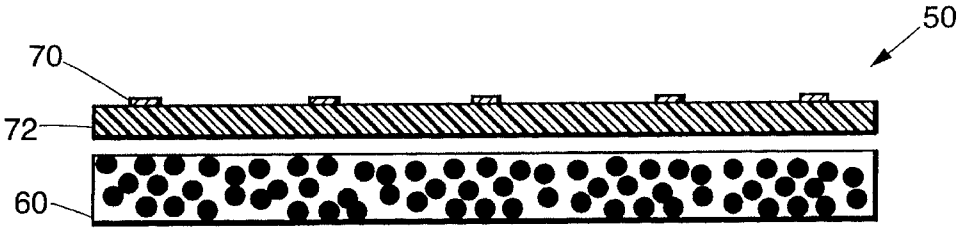
FIG. 1 is a simplified side view illustrating an array antenna system embodying this invention.

A simplified schematic illustration of an exemplary embodiment of the array system is shown in FIG. 1. This exemplary system 50 includes the ground plane 60, fabricated of a photonic band gap material in accordance with the invention, and the array of radiating elements 70 fabricated on a dielectric substrate 72. Preferably, the substrate 72 and ground plane 60 have no spacing therebetween; the ground plane 60 and substrate 72 are shown in an exploded fashion in FIG. 1.

In the exemplary embodiment of FIG. 1, the radiating elements 70 are radiating stub elements, so that the array is a stub array. The stub elements are defined by the open ends of microwave waveguides which are incorporated at the surface layer on top of the ground plane 60. The stub elements are the radiating/receiving elements in a transmitting antenna or a receiving antenna. Five elements 70 are shown in FIG. 1, of an exemplary three-by-five element array.

The diamond void structure 60 below the radiators 70 reflects all of the radiated power from the array elements 70 within a "stopband," i.e., within a finite frequency band in which the radiation fields are fully reflected back into free space. The photonic bandgap material from which the ground plane 60 is fabricated has a very broad stopband in contrast to a metallic ground plane which is frequency specific.

Figure 2:
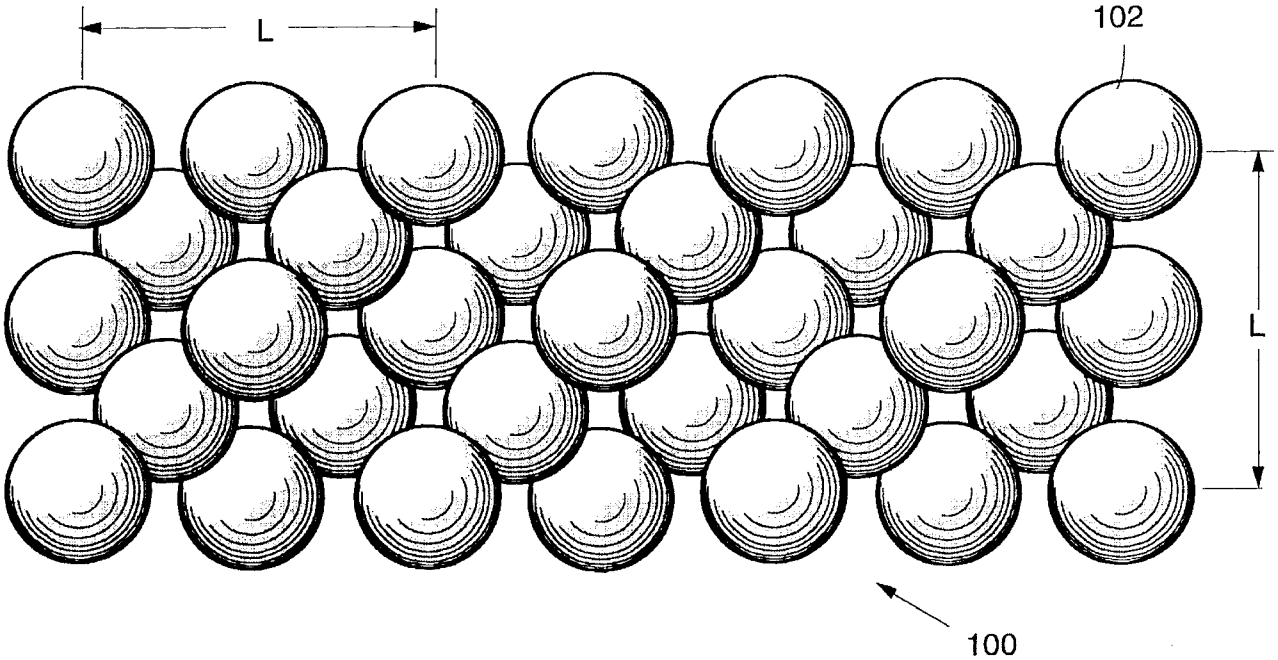
FIG. 2 illustrates a diamond lattice structure arrayed as a one by three structure, wherein the atoms in the lattice have been expanded to the maximum so that the atom spheres do not intersect.

FIG. 2 shows a diamond void lattice 100 arrayed as a one by three structure. This structure is one diamond lattice unit deep by one tall by three units wide. This represents one exemplary geometry for the diamond void structure. A diamond lattice is a geometric representation of the arrangement of atoms (carbon) that is formed by two interpenetrating face centered cubics. At all of the points of these cubes where the bond lines intersect, spherical voids 102 are placed in accordance with the invention. The "atoms" in this lattice, i.e., the voids 102, have been expanded to the maximum so that the atom void spheres do not intersect; i.e., the diameters of the "atoms"or voids 102 are increased to the maximum size possible without reaching a diameter size at which the voids would intersect. Maximum void density is achieved in this manner, i.e., the volumetric density of the voids is 82%.

It is desirable to achieve maximum void density, i.e., to minimize the ratio of dielectric volume of the photonic material to air. The stop band of the photonic crystal depends on the volume of the voids, and so a large stop bandwidth can be selected by choosing a large volume for the voids.

FIG. 2 represents a small structure which will be a small part of a much larger arrayed structure. The one by three array 100 will be used to demonstrate the feasibility of manufacturing the diamond void structure 60 in a assortment of high dielectric materials and by several manufacturing methods. "High" dielectric materials in this context are dielectric materials which have dielectric constants larger than 10 in the microwave frequency regime.

Figure 3:
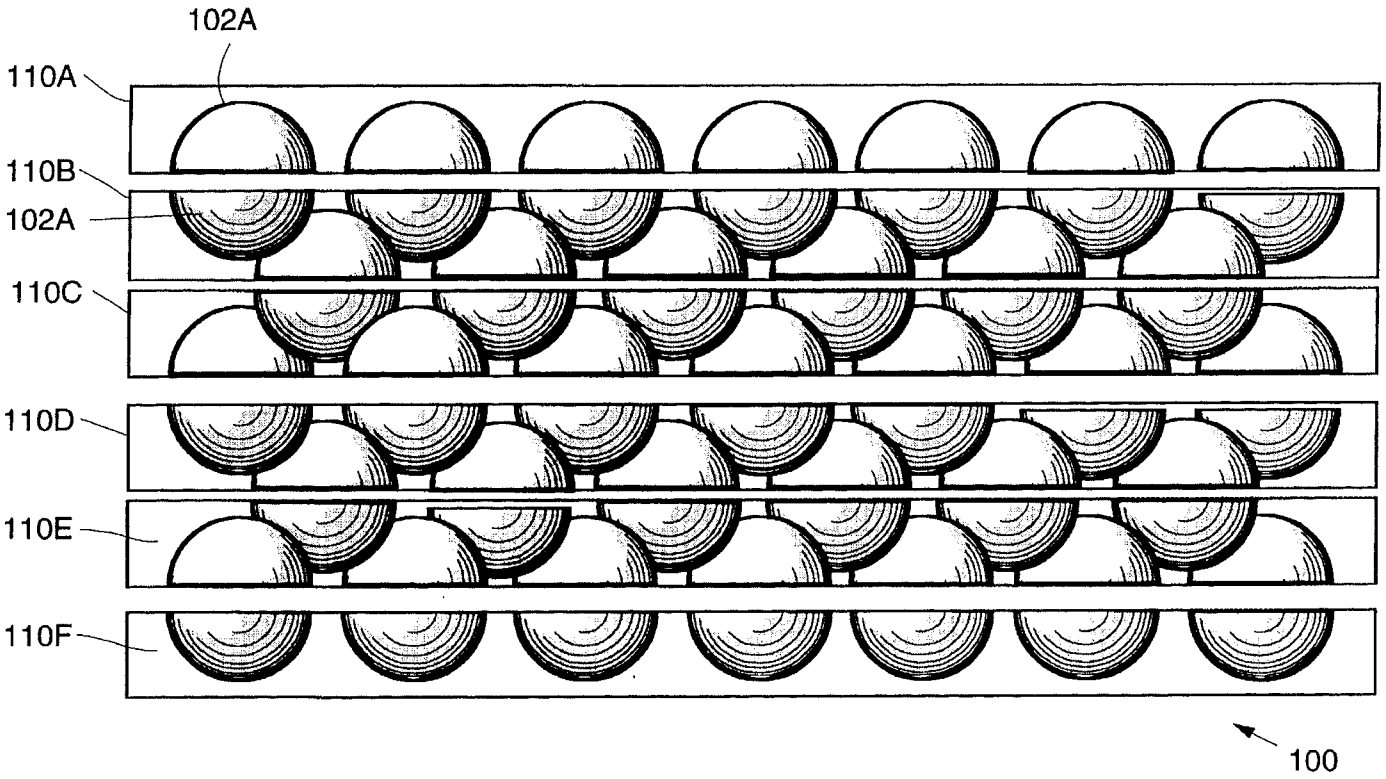
FIG. 3 illustrates the lattice structure of FIG. 2, dissected parallel to the 100 plane.

FIG. 3 shows the one by three array 100 of FIG. 2 dissected parallel to the 100 plane into slabs 100A–100F in the appropriate thickness that is determined by the centers of the voids representing the circular carbon atoms; due to the dissection, the spherical voids 102 are now hemispheres 102A as shown in FIG. 3. The 100 plane refers to the crystallographic plane of the diamond structure. The scaling of the dielectric slabs 100A–100F is in accordance with the lattice parameters of the face centered cubic structure of diamond. The lattice length L (FIG. 2) for the structure is equal to $\lambda/(2(\epsilon_r)^{1/2})$, where $\epsilon_r$ represents the effective dielectric constant presented by the void structure 100, and X is the wavelength at the center of the frequency band at which the ground plane 60 provides efficient reflection. Thus, each slab 102A–102F has a thickness equal to L/4, or $\lambda/(8(\epsilon_r)_{1/2})$.

The slabs 110A–110F are precast sections of high dielectric material, the photonic band gap material. The number of slabs in a ground plane structure determines the radiation field reflection of the structure. Measurements suggest that a 10 dB reflection can be achieved per slab.

The hemispherical voids 102A can be machined into the dielectric material. Alternatively, if the dielectric material is extremely hard, the hemispherical voids 102A can be ground and polished by using a numerically controlled machine and an ultrasonic grinding tool. If that is not practical, then the selected materials can be wet etched with a gradient mask that dissolves slowly opening up the etching area as a function of time and depth. If the liquid etching process is not feasible, then reactive ion etching is an alternative technique. Very accurate geometries can be achieved with the reactive ion etching technique as well as highly accurate registration. Another consideration is the fact that if spheres are not the ideal geometry for the ground plane, then reactive ion etching can generate ellipsoids, paraboloids or any other shape that will yield the optimum performance in the photonic band gap material.

Figure 4:
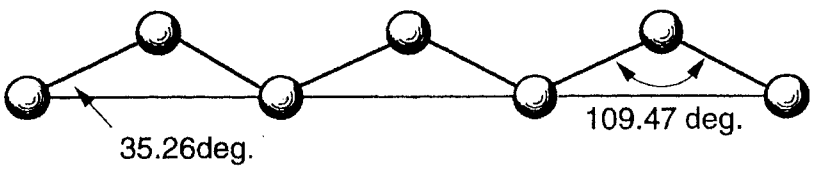
FIG. 4 is a simplified diagram showing carbon atoms and bond links for a diamond lattice structure.

Table 1 below shows various exemplary materials that can be employed for the photonic band gap structures, with their respective dielectric constants and absorption loss characteristics at two exemplary frequencies, 2 GHz and 20 GHz. Table 2 shows the various dimensions for the spheres given the mid-gap frequency range and lattice parameter. FIG. 4 is a simplified schematic diagram showing the carbon atoms, bond links along the 100 plane, and the angles included between adjacent bond links (35.26 and 109.47 degrees, respectively) for the diamond lattice. The dimensions in Table 2 are calculated without taking into account the relative dielectric constant of the photonic crystal material. To take this into account, one would calculate the effective dielectric constant for the diamond void structure, which is mostly air, and then use the known relationship between the lattice dimension, wavelength of the radiation and the dielectric constant. The effective dielectric constant could be determined by taking the weighted average of the dielectric constant of the high dielectric material and that of air, wherein the weighting is by the volume of dielectric to volume of air.

TABLE 1

| Ceramic | Dielectric Constant | tan δ(2 GHz) | tan δ(20 GHz) |
|---|---|---|---|
| $Ba_2Ti_9O_{20}$ | 40 | $6.1 \times 10^{-5}$ | 0.001 |
| $Zr_{0.8}TiSn_{0.2}O_4$ | 38 | $6.7 \times 10^{-5}$ | $3.3 \times 10^{-4}$ |
| $Ba[Sn_x(Mg_{1/3}Ta_{2/3})_{1-x}]O_3$ | 25 | $2.5 \times 10^{-5}$ | $1.0 \times 10^{-4}$ |
| $Ba(Mg_{1/3}Ta_{2/3})O_3$[5] | 24.6 | $1.7 \times 10^{-4}$ (7 GHz) | — |
| $Nd_2O_3$—BaO—$TiO_2Bi_2O_3$ | 90 | $3.3 \times 10^{-4}$ | — |

TABLE 2

| Frequency (GHz) | Lattice Length (cm) | Void Diameter (cm) |
|---|---|---|
| 14.7 | 0.127 | 0.0548 |
| 9.4 | 0.199 | 0.0858 |
| 5.9 | 0.317 | 0.137 |
| 3.7 | 0.507 | 0.218 |
| 2.3 | 0.815 | 0.352 |

In a particular example, if the frequency of operation is chosen as 14.7 GHz, then the diamond lattice length L is 0.127 cm. This means that in order for the spherical voids to be at maximum size while maintaining the diamond lattice structure, they must have a diameter of no more than 0.055 cm. This dimensional configuration is a good candidate for the chemical etching process described above, as well as the lithography, plasma etching and reactive ion etching processes. The larger structures greater than 0.08 cm are very good candidates for mechanical grinding and polishing techniques.

This maximum spherical void diameter is dictated by the interaction of the corner sphere of the diamond structure and the internal spheres. These two spheres or void locations are the closest spheres in the diamond face centered cubic and scaling these two to the maximum before they intersect rules just how much void space one can obtain in the unit diamond cube. Table 2 shows the relationship between the mid-gap or center frequency and the spherical void dimension for several exemplary frequencies. The lattice length for the structure is given by the relationship $\lambda/(2(\epsilon_r)^{1/2})$. Given the lattice length, the locations and void diameter can readily be calculated for the diamond lattice structure.

Figure 5:
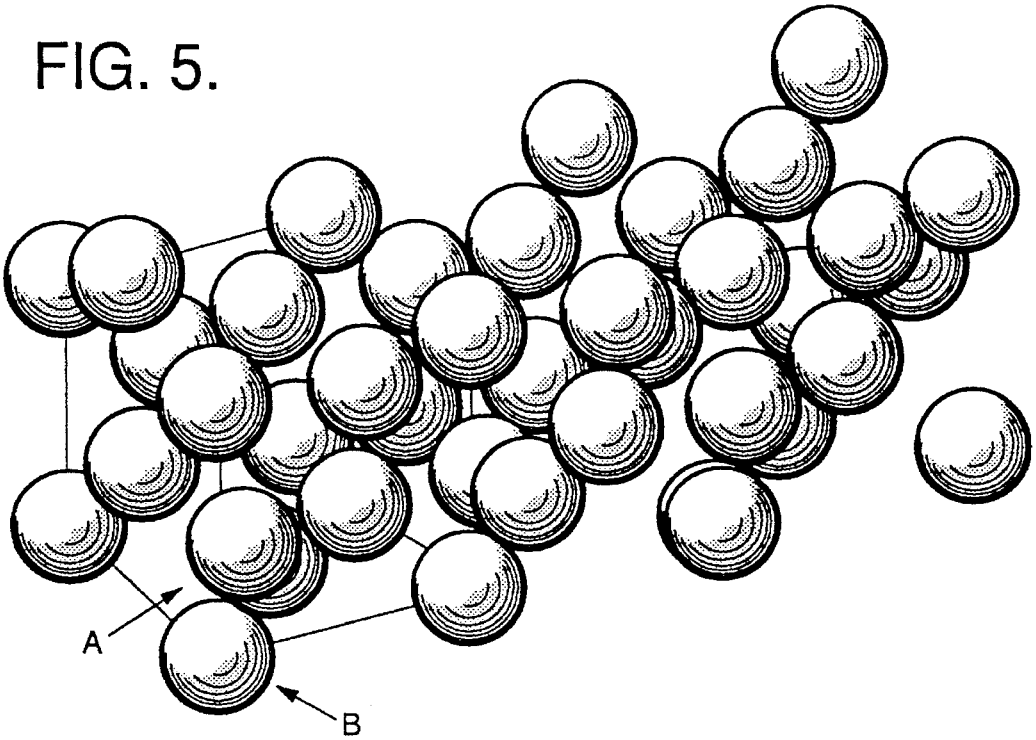
FIG. 5 and FIG. 6 respectively illustrate the diamond lattice structure in a perspective view and in dissected layers to show the limiting void sphere diameter that allows an 82% void structure.
Figure 6:
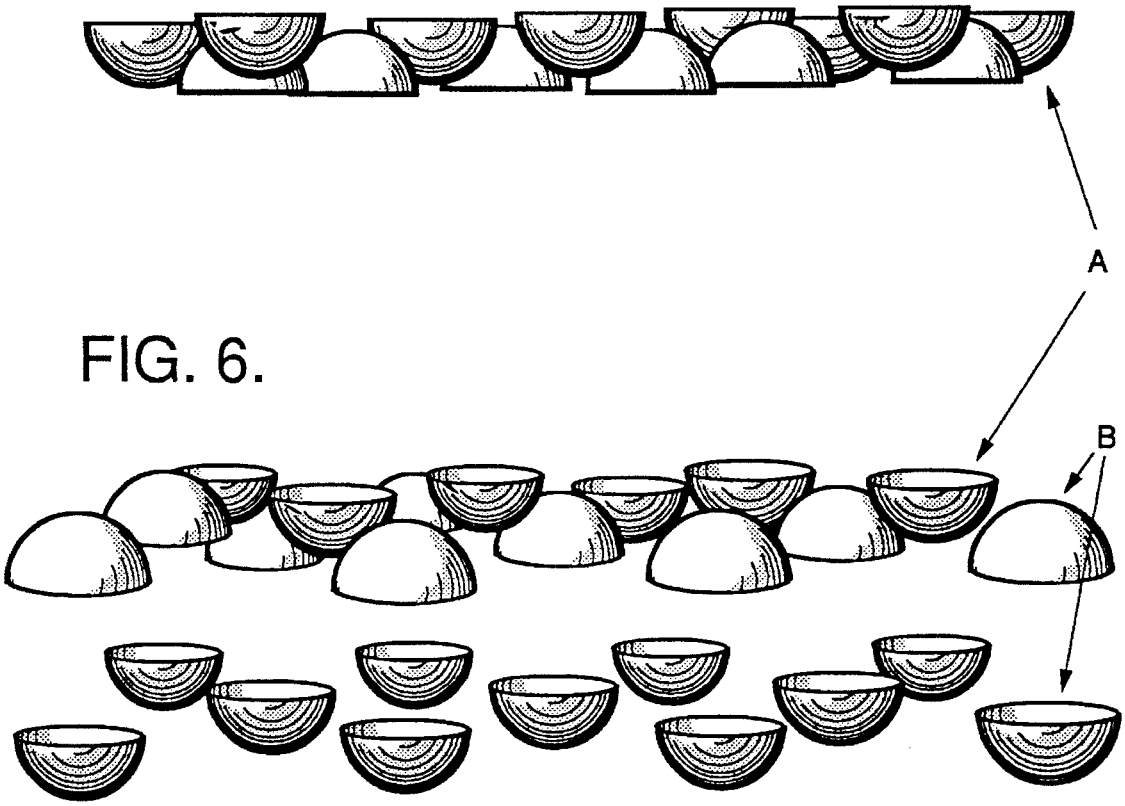

FIG. 5 and FIG. 6 show the limiting void sphere diameter that allows an 82% void structure. If the diameters of voids A and B were allowed to increase to a size greater than that shown in FIGS. 5 and 6, the voids A and B would intersect, thus decreasing the effectiveness of the design. This is because the diamond structure would no longer exist.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An antenna array comprising:

an array of radiators; and a substrate disposed below said array of radiators for reflecting incident energy radiated by said array, said substrate comprising a layer of dielectric photonic band gap material, said layer comprising a periodic structure of nonintersecting voids formed in said dielectric material to form a diamond lattice void structure emulating an atomic diamond lattice structure, said substrate fabricated without resonant defects in said periodic structure of voids.

2. The array of claim 1 wherein said dielectric material comprises $Ba_2Ti_9O_{20}$.

3. The array of claim 1 wherein said dielectric material comprises $Zr_{0.8}TiSn_{0.2}O_4$.

4. The array of claim 1 wherein said dielectric material comprises $Ba[Sn_x(Mg_{1/3}Ta_{2/3})_{1-x}]O_3$.

5. The array of claim 1 wherein said dielectric material comprises $Ba(Mg_{1/3}Ta_{2/3})O_3$[5].

6. The array of claim 1 wherein said dielectric material comprises $Nd_2O_3$—BaO—$TiO_2Bi_2O_3$.

7. The array of claim 1 wherein said void lattice structure is defined by a plurality of unit structures emulating the diamond face centered cubic, said unit structure having a unit cube dimension, and wherein said dimension is equal to $\lambda/(2(\epsilon_r)^{1/2})$, where $\lambda$ is the wavelength at a microwave frequency of operation of said array, and $\epsilon_r$ is the effective dielectric constant of said void structure.

8. The array of claim 1 wherein said voids are spherical and have a diameter selected to maximize a volume of said voids within said diamond lattice void structure while maintaining said emulation of a diamond lattice structure.

9. The array of claim 8 wherein said volume of said voids is 82% of a volume of said void structure.

10. The array of claim 1 wherein said array of radiators and said substrate form an omnidirectional antenna.

11. An antenna array comprising:

an array of radiators; and a diamond lattice void reflecting structure disposed below said array of radiators for reflecting incident energy radiated by said array, said diamond lattice void structure comprising a periodic array of nonintersecting voids formed in a high dielectric material to define a diamond lattice void structure emulating an atomic diamond lattice structure, wherein the high dielectric material has a relative dielectric constant which exceeds 10, and wherein the diamond lattice void structure is free of resonant defects.

12. The array of claim 11 wherein said lattice void structure is defined by a plurality of unit structures emulating the diamond face centered cubic, said unit structure having a unit cube dimension, and wherein said dimension is equal to $\lambda/(2(\epsilon_r)^{1/2})$, where $\lambda$ is the wavelength at a microwave frequency of operation of said array, and $\epsilon_r$ is the effective dielectric constant of said void structure.

13. The array of claim 11 wherein said voids are spherical and have a diameter selected to maximize a volume of said voids within said structure while maintaining said emulation of a diamond lattice structure.

14. The array of claim 13 wherein said volume of said voids is 82% of a volume of said void structure.

15. The array of claim 11 wherein said reflecting surface comprises a plurality of slabs of a high dielectric, photonic band gap material, the slabs having a predetermined thickness, each slab having first and second surfaces and having formed therein a predetermined pattern of voids, said slabs being assembled together to form said void structure.

16. The array of claim 15 wherein a pattern of hemispherical voids is formed in said slabs, and wherein when said slabs are assembled together, corresponding hemispherical voids in adjacent slabs are matched together to define a pattern of spherical voids in said void structure.

17. The array of claim 11 wherein said array of radiators and said reflecting structure form an omnidirectional antenna.

* * * * *